US007819790B2

(12) United States Patent
Grischenko et al.

(10) Patent No.: US 7,819,790 B2
(45) Date of Patent: Oct. 26, 2010

(54) APPARATUS FOR MAKING PAPERBOARD PRESSWARE WITH CONTROLLED BLANK FEED

(75) Inventors: Grigory I. Grischenko, Cliffside Park, NJ (US); Alois A. Schmidtner, Hellertown, PA (US); Paul J. England, Suwanee, GA (US); Albert D. Johns, Saylorsburg, PA (US); Thomas W. Zelinski, Menasha, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 1025 days.

(21) Appl. No.: 11/057,959

(22) Filed: Feb. 15, 2005

(65) Prior Publication Data

US 2005/0192171 A1 Sep. 1, 2005

Related U.S. Application Data

(60) Provisional application No. 60/546,461, filed on Feb. 20, 2004.

(51) Int. Cl.
*B31B 43/00* (2006.01)

(52) U.S. Cl. ..... 493/73; 493/52; 493/56; 493/75; 100/45; 100/215

(58) Field of Classification Search ..... 493/52, 493/56, 59, 61, 73, 75; 100/215, 45
See application file for complete search history.

(56) References Cited

U.S. PATENT DOCUMENTS

| | | | | |
|---|---|---|---|---|
| 1,793,089 | A | 2/1931 | Heyes | |
| 2,332,937 | A | 10/1943 | Schmidberger | 18/16 |
| 2,595,046 | A | 4/1952 | Amberg | 93/1.3 |
| 2,832,522 | A | 4/1958 | Schlanger | 229/2.5 |
| 3,228,066 | A | 1/1966 | Rippstein | 18/19 |
| 3,305,434 | A | 2/1967 | Bernier et al. | 162/117 |
| 3,512,332 | A * | 5/1970 | Klein | 53/449 |
| 3,958,394 | A * | 5/1976 | Mahaffy et al. | 53/511 |
| 4,150,936 | A | 4/1979 | Shioi et al. | 425/397 |
| 4,236,708 | A * | 12/1980 | Matsuo | 271/12 |
| 4,242,293 | A * | 12/1980 | Dowd | 264/40.7 |
| 4,359,214 | A | 11/1982 | Eldridge | 271/5 |
| 4,435,143 | A * | 3/1984 | Dempsey | 425/150 |
| 4,494,745 | A | 1/1985 | Ward, Sr. et al. | 271/95 |
| 4,588,539 | A | 5/1986 | Rossi et al. | 264/40.5 |
| 4,606,496 | A | 8/1986 | Marx et al. | 229/2.5 R |
| 4,609,140 | A | 9/1986 | Van Handel et al. | 229/2.5 R |
| 4,721,499 | A | 1/1988 | Marx et al. | 493/152 |
| 4,721,500 | A | 1/1988 | Marx et al. | 493/152 |
| 4,748,792 | A | 6/1988 | Jeffrey | 53/116 |
| 4,755,128 | A | 7/1988 | Alexander et al. | 425/292 |
| 4,778,439 | A * | 10/1988 | Alexander | 493/169 |
| 4,781,566 | A | 11/1988 | Rossi et al. | 425/400 |
| 4,832,676 | A | 5/1989 | Johns et al. | 493/152 |
| 5,026,040 | A | 6/1991 | Gibert | 271/35 |
| 5,074,539 | A | 12/1991 | Wells et al. | 271/12 |
| 5,129,874 | A | 7/1992 | Hayes, III et al. | 493/167 |
| 5,163,891 | A | 11/1992 | Goldsborough et al. | 493/321 |

(Continued)

*Primary Examiner*—Christopher Harmon

(57) ABSTRACT

An improved apparatus for making pressware features a vacuum belt feeder which accelerates and decelerates a feed blank for controlled insertion into a forming die as well as retainers to limit bounce back of the blank off of forward stops. A pneumatic ejector on the forming ram facilitates product removal.

26 Claims, 14 Drawing Sheets

U.S. PATENT DOCUMENTS 5,203,491 A 4/1993 Marx et al. ..... 229/2.5 R
5,249,946 A 10/1993 Marx ..... 425/142
5,326,020 A 7/1994 Cheshire et al. ..... 229/2.5 S
5,364,583 A 11/1994 Hayashi ..... 264/335
5,383,392 A * 1/1995 Kowalewski et al. ..... 101/183
5,509,352 A * 4/1996 Kowalewski et al. ..... 101/232
5,693,346 A 12/1997 Dull et al. ..... 425/139
5,816,994 A 10/1998 Hill et al. ..... 493/324
5,938,112 A 8/1999 Sandstrom ..... 229/407
5,945,137 A 8/1999 Mizuno et al. ..... 425/302.1
6,474,497 B1 11/2002 Littlejohn et al. ..... 220/574
6,527,687 B1 3/2003 Fortney et al. ..... 493/51
6,585,506 B1 7/2003 Johns et al. ..... 425/170
6,589,043 B1 7/2003 Johns et al. ..... 425/403.1
6,592,357 B1 7/2003 Johns et al. ..... 425/397
6,715,630 B2 4/2004 Littlejohn et al. ..... 220/573
6,733,852 B2 5/2004 Littlejohn et al. ..... 428/35.7
6,893,693 B2 5/2005 Swoboda et al. ..... 428/134

* cited by examiner 78
82
84
82

42
44
50
74
70
54
66
62
56
66
64
52
82
84
78
60
76
80
86
68
36
68
34
30

APPARATUS FOR MAKING PAPERBOARD PRESSWARE WITH CONTROLLED BLANK FEED

PRIORITY CLAIM

This application is based upon U.S. Provisional Application Ser. No. 60/546,461 of the same title, filed Feb. 20, 2004, the priority of which is hereby claimed.

TECHNICAL FIELD

The present invention relates generally to pressed paperboard disposable containers and more specifically to improved apparatus for making paperboard pressware such as paper plates, bowls, platters and the like from paperboard blanks. In preferred embodiments, the present invention provides for controlled insertion of a paperboard blank into a forming die set, bounce back limiting retainers and improved pneumatic assist for ejecting product from a forming station.

BACKGROUND

Disposable paper plates and the like are generally either pressed paperboard containers or are pulp molded. Pulp molded articles, after drying, are strong and rigid but generally have rough surface characteristics. They are not usually coated and are susceptible to penetration by water, oil and other liquids. Pressed paperboard containers, on the other hand, can be decorated and coated with a liquid-resistant coating before being pressed by the forming dies into the desired shape. General background with respect to pressed paperboard containers is seen in U.S. Pat. No. 4,606,496 entitled "Rigid Paperboard Container" of R. P. Marx et al.; U.S. Pat. No. 4,609,140 entitled "Rigid Paperboard Container and Method and Apparatus for Producing Same" of G. J. Van Handel et al.; U.S. Pat. No. 4,721,499 entitled "Method of Producing a Rigid Paperboard Container" of R. P. Marx et al.; U.S. Pat. No. 4,721,500 entitled "Method of Forming a Rigid Paper-Board Container" of G. J. Van Handel et al.; and U.S. Pat. No. 5,203,491 entitled "Bake-In Press-Formed Container" of R. P. Marx et al. Equipment and methods for making paperboard containers are also disclosed in U.S. Pat. No. 4,781,566 entitled "Apparatus and Related Method for Aligning Irregular Blanks Relative to a Die Half" of A. F. Rossi et al.; U.S. Pat. No. 4,832,676 entitled "Method and Apparatus for Forming Paperboard Containers" of A. D. Johns et al.; and U.S. Pat. No. 5,249,946 entitled "Plate Forming Die Set" of R. P. Marx et al. The forming section may typically include a plurality of reciprocating upper die halves opposing, in facing relationship, a plurality of lower die halves. The upper die halves are mounted for reciprocating movement in a direction that is oblique or inclined with respect to the vertical plane. The paperboard blanks, after cutting, are gravity fed to the inclined lower die halves in the forming section. The construction of the die halves and the equipment on which they are mounted may be substantially conventional; for example, as utilized on presses manufactured by the Peerless Manufacturing Company. Optionally included are hydraulic controls. See U.S. Pat. No. 4,588,539 to Rossi et al. For paperboard plate stock of conventional thicknesses i.e. in the range of from about 0.010 to about 0.040 inches, it is preferred that the spacing between the upper die surface and the lower die surface is as taught in U.S. Pat. Nos. 4,721,499 and 4,721,500. Note also the following patents of general interest with respect to forming paperboard containers: U.S. Pat. No. 6,527,687 to Fortney et al. which discloses a cut-in-place forming system with a draw ring and so forth. See Cols. 6-8; U.S. Pat. No. 3,305,434 to Bernier et al . which discloses a paperboard forming apparatus; U.S. Pat. No. 2,832,522 to Schlanger which discloses another paperboard forming apparatus; U.S. Pat. No. 2,595,046 to Amberg discloses still yet another paperboard forming apparatus.

As to further methods of aligning articles in a manufacturing process, see U.S. Pat. No. 5,129,874 to Hayes, III et al. and U.S. Pat. No. 4,150,936 to Shioi et al.

As to air assist in pressware and related apparatus, see U.S. Pat. No. 4,755,128 to Alexander et al.; U.S. Pat. No. 1,793,089 to Heyes; U.S. Pat. No. 5,693,346 to Dull et al.; U.S. Pat. No. 5,364,583 to Hayashi; and U.S. Pat. No. 2,332,937 to Schmidberger.

Despite many advances over the years in equipment for making pressware from paperboard, manufacturing issues remain. For one, it is desirable to more speedily and reliably supply blanks to pressware die sets for pressing into containers. For another, if paperboard blanks are not suitably positioned "on center" in the forming dies then "off center" and potentially unusable product results. Still yet another continuing issue with respect to pressing operations is the ability to reliably remove formed product from the pressing die because of the short cycle times associated with efficient operation of the machinery. In commercial operations it is desirable to operate a die set at over 50 pressings per minute or so in many cases.

SUMMARY OF INVENTION

Generally, the present invention is directed to improved apparatus and methods for producing pressware from paperboard blanks with improvements such as improved blank feed, bounce back control and pneumatic assist for removing formed product from the forming cavity.

In one aspect, the present invention is directed to the combination comprising: (a) a die set including a punch and a die adapted for reciprocal motion with respect to each other and configured to cooperate in order to form a shaped product from a substantially planar paperboard blank upon pressing thereof; (b) a variable speed blank feeder for controlled insertion of the paperboard blank into the die set including: (i) a pervious feed belt adjacent the die set; (ii) a vacuum source communicating with the pervious feed belt, the feed belt and vacuum source being adapted for receiving the paperboard blank and releasably securing it to a surface of the belt; (iii) variable speed drive means suitable for advancing the feed belt in a feeding direction, the drive means being capable of accelerating the belt from a stationary condition between feeds to the die set to an elevated feed belt velocity during a blank feed step as well as decelerating the feed belt during the feed step to a lesser velocity, whereupon the blank is released to the die set at a velocity less than the elevated feed belt velocity. Preferably, the pervious feed belt, vacuum source and drive means are adapted to cooperate to feed a paperboard blank to the die set while the blank is at least partially engaged with the pervious feed belt and the pervious feed belt is provided with positive engagement means, such as a timing belt wherein the drive means includes at least two sprocket wheels. The apparatus typically includes retractable stop means for stopping a blank supplied to the feeder on the feed belt and optionally includes a tamper configured to urge the paperboard blank into contact with the pervious feed belt. The vacuum source may be a variable (i.e., intermittent) vacuum source or the vacuum source may be a continuous vacuum source. In general, the duration of the blank feed step is less than 1 second with the duration of the blank feed step being less than 0.5 seconds in typical applications. Less than about 0.25 seconds, such as 0.1 seconds or less, is readily achieved for the duration of the blank feed step. Elevated belt velocities between about 750 fpm and 1500 fpm are suitable, i.e., from about 950 to about 1350 fpm. Average velocities of the belt during the feed step may be from about 400-800 fpm, suitably from about 500 fpm to about 700 fpm. The pervious belt has a circumference of from about 2.2 to about 2.8 times the length of the paperboard blank in a typical embodiment.

Another aspect of the invention includes the combination comprising: (a) a plurality of die sets, each including a punch and a die adapted for reciprocal motion with respect to each other and configured to cooperate in order to form a shaped product from a substantially planar paperboard blank upon pressing thereof; (b) a plurality of variable speed, active blank feeders for controlled insertion of the paperboard blanks into the die sets, each blank feeder including: (i) a pervious feed belt adjacent its associated die set; (ii) a vacuum source communicating with the pervious feed belt, the feed belt and vacuum source being adapted for receiving paperboard blanks and releasably securing them to a surface of the belt; (c) a common variable speed drive means suitable for concurrently advancing the feed belts of the blank feeders in a feeding direction, the drive means being capable of accelerating the belts from a stationary condition between feeds to the die sets to an elevated feed belt velocity during a blank feed step as well as decelerating the feed belts during the feed step to a lesser velocity, whereupon the blanks are released to their associated die sets at a velocity less than the elevated feed belt velocity.

Still yet another aspect of the invention is a method for making pressed paperboard articles, comprising: (a) providing a paperboard blank to a variable speed, active blank feeder including: (b) (i) a pervious feed belt; (ii) a vacuum source communicating with the pervious feed belt, the feed belt and vacuum source being adapted for receiving the paperboard blank and releasably securing it to a surface of the belt; and (iii) variable speed drive means suitable for advancing the feed belt in a feeding direction; (c) stopping the blank on the pervious feed belt and securing it thereto by way of applying vacuum to the pervious belt; (d) feeding the blank from the feeder to a die set including a punch and a die adapted for reciprocal motion with respect to each other and configured to cooperate in order to form a shaped product from a substantially planar paperboard blank upon pressing thereof, the step of feeding the blank to the die set including accelerating the belt from a stationary condition to an elevated feed belt velocity, and decelerating the belt, whereupon the blank is released to the die set at a velocity less than the elevated feed belt velocity.

The paperboard blank is secured to the vacuum belt by vacuum of from about 5 to about 30 inches of water; typically by vacuum of from about 7.5 to about 15 inches of water. The blank is preferably at least partially secured to the pervious belt when fed to the die set and is a scored paperboard blank with a clay coating.

Another improvement of the invention comprises ramped rearward blank retaining means provided with a sloped outer guide surface and an inner retaining lip, the sloped outer guide surface being configured to allow the paperboard blank to slide over the rearward blank retaining means and the inner retaining lip extending in a direction transverse to the production direction and configured to limit bounce back of the blank with respect to the forming dies. Generally, the die set has a processing surface for receiving the paperboard blank and the rearward blank retaining means comprise a plurality of ramped rearward blank retainers, each of which has a sloped outer surface configured to allow the paperboard blank to slide over the blank retainer and an inner retaining lip extending transversely to the processing surface configured to limit bounce back of the blank with respect to the forming dies.

In a typical embodiment, the improvement consists of two ramped rearward blank retainers; the two rearward blank retainers are symmetrically offset from a central axis of the die set extending in a production direction, wherein the two blank retainers are offset from the central axis at an angle of from about 30 to about 50 degrees. So also, in a preferred construction the inner lips of the blank retainers include surfaces adjacent the processing surface of the die set extending in a direction substantially perpendicular thereto and the sloped guide surface of the ramped rearward blank retaining means has a substantially linear profile defining an angle with respect to a processing surface of the die set of from about 5 to about 20 degrees. The edge of the paperboard blank most preferably has a radius of curvature of from about 3 to about 6 inches and the retaining lip has an inner radius of curvature substantially equal to that of the paperboard blank. The retaining lip projects away from an adjacent processing surface of the die set a distance of from about 0.15 to about 0.3 inches for typical paperboard pressware die sets.

An improved die set for making pressware from paperboard blanks includes: (a) an upper punch and a lower die having an outer processing surface, the die set being configured to receive a paperboard blank fed thereto along a production direction and including forward blank stop means for stopping the fed blank and positioning it for forming; and (b) a plurality of ramped retainers adapted to limit blank bounce back during processing, each of the retainers including an inner lip transverse to the processing surface adapted to engage the blank upon bounce back and retain it in the die and a sloped outer guide surface shaped to allow a fed blank to slide over the ramped retainer.

Still another improvement of the invention is a pressing apparatus for making paperboard pressware comprising: (a) a pressware die set including a punch and a die; (b) a forming ram upon which the punch is mounted, the mounting ram being adapted for reciprocating motion; (c) means for mounting the die in opposed facing relationship with the forming ram; (d) paperboard blank feeder means for providing paperboard blanks to the die, the pressing apparatus being of the class wherein the forming ram reciprocally drives the punch to the die with a paperboard blank therebetween in order to form the pressware and another blank is fed to the die along a blank feed path upon ejection of the formed product; the apparatus being further provided with: (e) a pneumatic product ejector mounted on the forming ram adapted to output on ejector air stream incident upon formed product in order to facilitate removal of formed product from the die set, the product ejector being disposed such that its output air stream avoids the feed path of the blanks fed to the apparatus. Typically, the output air stream of the pneumatic product ejector is along a production direction.

In most cases the paperboard pressware made by way of the improved apparatus of the invention has a caliper of from about 10 to about 25 mils.

BRIEF DESCRIPTION OF DRAWINGS

The invention is described in detail below in connection with the appended drawings wherein like numerals designate like parts and wherein.

DETAILED DESCRIPTION

Figure 1:
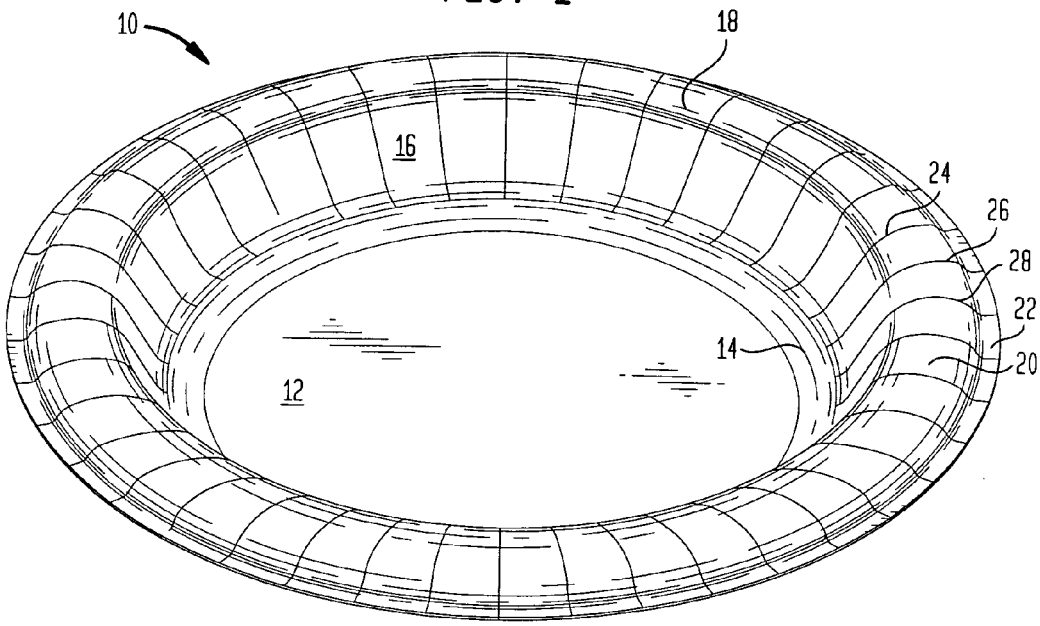
FIG. 1 is a perspective view of a pressed paperboard plate of the class produced in connection with the present invention.

The invention is described in detail below with reference to numerous embodiments for purposes of exemplification and illustration only. Modifications to particular embodiments within the spirit and scope of the present invention, set forth in the appended claims, will be readily apparent to those of skill in the art.

As used herein, terminology is given its ordinary meaning unless a more specific definition is given or the context indicates otherwise. "Mil", "mils" and like terminology refers to thousandths of an inch and dimensions are given in inches unless otherwise specified. Caliper is the thickness of material and is expressed in mils. "FPM" and like terminology refers to feet per minute.

Pressed articles prepared by way of the invention include disposable servingware containers such as paperboard containers in the form of plates, both compartmented and non-compartmented, as well as bowls, trays, and platters. The products are typically round or oval in shape but can also be hexagonal, octagonal, or multi-sided. The containers produced by way of the invention generally include a plurality of radially extending, circumferentially spaced pleats, preferably formed of rebonded paperboard lamellae as is known in the art.

The present invention is typically practiced in connection with segmented dies generally as are known and further discussed herein. Manufacture from coated paperboard is preferred. Clay coated paperboard is typically printed, coated with a functional grease/water resistant barrier and moistened prior to blanking and forming. The printed, coated and moistened paperboard roll is then transferred to a web feed blanking press where the blanks are cut in a straight across, staggered, or nested pattern (to minimize scrap). The blanks are transferred to the multi-up forming tool via individual transfer chutes. The blanks will commonly hit against forward blank stops at the forward portion of the die set (rigid or pin stops that can rotate) for final positioning prior to forming. The stop heights and locations are chosen to accurately locate the blank and allow the formed product to be removed from the tooling without interference. Typically the inner portions of the blank stops or inner blank stops are lower in height since the formed product must pass over them.

Instead of web forming, blanks could be rotary cut or reciprocally cut off-line in a separate operation. The blanks could be transferred to the forming tooling via transfer chutes using a blank feed style press. The overall productivity of a blank feed style press is typically lower than a web feed style press since the stacks of blanks must be continually inserted into the feed section, the presses are commonly narrow in width with fewer forming positions available and the forming speeds are commonly less since fluid hydraulics are typically used versus mechanical cams and gears.

As noted, the blank is typically positioned by rigid or rotating pin stops as well as by side edge guides that contact the blank diameter. The punch pressure ring contacts the blank, clamping it against the lower draw ring and optional relief area to provide initial pleating control. The upper punch and lower die knock-outs (that may have compartment ribs machined into them) then contact the paperboard holding the blank on center. The upper knock-out is sometimes an articulated style having spring pre-load and full loads and 0.030 inch to 0.120 inch articulation stroke during the formation. The pressure ring may have the outer product profile machined into it and provides further pleating control by clamping the blank between its profile area and die outer profile during the formation. The draw ring and pressure rings springs typically are chosen in the manner to allow full movement of the draw ring prior to pressure ring movement (i.e., full spring force of draw ring is less than or equal to the pre-load of the pressure ring springs).

The following patents and co-pending patent applications contain further information as to materials, processing techniques and equipment and are also incorporated by reference: U.S. application Ser. No. 10/963,686, entitled, Pressed Paperboard Servingware with Improved Rigidity and Rim Stiffness", now United States Published Application No. 2006/0208054; U.S. Pat. No. 6,715,630, entitled "Disposable Food Container With A Linear Sidewall Profile and an Arcuate Outer Flange"; U.S. Pat. No. 6,733,852, entitled "Disposable Serving Plate With Sidewall-Engaged Sealing Cover", U.S. Pat. No. 6,474,497, entitled "Smooth Profiled Food Service Articles" U.S. application Ser. No. 10/004,874, entitled "High Gloss Disposable Pressware", now U.S. Pat. No. 6,893,693; U.S. application Ser. No. 09/978,484, entitled "Deep Dish Disposable Pressed Paperboard Container", now U.S. Pat. No. 7,048,176; U.S. Pat. No. 6,585,506, entitled "Side Mounted Temperature Probe for Pressware Die Sets"; U.S. Pat No. 6,592,357, entitled "Rotating Inertial Pin Blank Stops for Pressware Die Sets"; U.S. Pat. No. 6,589,043, entitled "Punch Stripper Ring Knock-Out for Pressware Die Sets"; and U.S. application Ser. No. 10/600,814, entitled "Disposable Servingware Containers with Flange Tabs", now U.S. Pat. No. 7,337,943. See also, U.S. Pat. Nos. 5,249,946; 4,832,676; 4,721,500; and 4,609,140, which are particularly pertinent.

As to conveying equipment which may be utilized in manufacturing operations, note the following: U.S. Pat. No. 5,945,137 to Mizuno et al.; U.S. Pat. No. 5,816,994 to Hill et al.; U.S. Pat. No. 5,163,891 to Goldsborough et al.; U.S. Pat. No. 5,074,539 to Wells et al.; U.S. Pat. No. 5,026,040 to Gibert; U.S. Pat. No. 4,748,792 to Jeffrey; U.S. Pat. No. 4,494,745 to Ward, Sr. et al.; U.S. Pat. No. 4,359,214 to Eldridge; and U.S. Pat. No. 3,228,066 to Rippstein.

The invention is advantageously practiced in connection with a heated matched pressware die set utilizing inertial rotating pin blank stops as described in co-pending application U.S. Ser. No. 09/653,577, filed Aug. 31, 2000, now U.S. Pat. No. 6,592,357. For paperboard plate stock of conventional thicknesses in the range of from about 0.010 to about 0.040 inches, the springs upon which the lower die half is mounted are typically constructed of from about 6000 to 10,000 pounds or higher. Similar forming pressures and control thereof may likewise be accomplished using hydraulics as will be appreciated by one of skill in the art. The paperboard which is formed into the blanks is conventionally produced by a wet laid paper making process and is typically available in the form of a continuous web on a roll. The paperboard stock is preferred to have a basis weight in the range of from about 100 pounds to about 400 pounds per 3000 square foot ream and a thickness or caliper in the range of from about 0.010 to about 0.040 inches as noted above. Lower basis weight paperboard is preferred for ease of forming and to save on feedstock costs. Paperboard stock utilized for forming paper plates is typically formed from bleached pulp fiber and is usually double clay coated on one side. Such paperboard stock commonly has a moisture (water content) varying from about 4.0 to about 8.0 percent by weight.

The effect of the compressive forces at the rim is greatest when the proper moisture conditions are maintained within the paperboard: at least 8 % and less than 12 % water by weight, and preferably 9.0 to 10.5 %. Paperboard having moisture in this range has sufficient moisture to deform under pressure, but not such excessive moisture that water vapor interferes with the forming operation or that the paperboard is too weak to withstand the high compressive forces applied. To achieve the desired moisture levels within the paperboard stock as it comes off the roll, the paperboard is treated by spraying or rolling on a moistening solution, primarily water, although other components such as lubricants may be added. The moisture content may be monitored with a hand held capacitive type moisture meter to verify that the desired moisture conditions are being maintained or the moisture is monitored by other suitable means, such as an infra-red system. It is preferred that the plate stock not be formed for at least six hours after moistening to allow the moisture within the paperboard to reach equilibrium.

Because of the intended end use of the products, the paperboard stock is typically impregnated with starch and coated on one side with a liquid proof layer or layers comprising a press-applied, water-based coating applied over the inorganic pigment typically applied to the board during manufacturing. In addition, for esthetic reasons, the paperboard stock is often initially printed before being coated with an overcoat layer. As an example of typical coating material, a first layer of latex coating may be applied over the printed paperboard with a second layer of acrylic coating applied over the first layer. These coatings may be applied either using the conventional printing press used to apply the decorative printing or may be applied using some other form of a conventional press coater. Preferred coatings utilized in connection with the invention may include 2 pigment (clay) containing layers, with a binder, of 3 lbs/3000 $ft^2$ ream or so followed by 2 acrylic layers of about 0.5-1 lbs/3000 $ft^2$ ream. The layers are applied by press coating methods, i.e., gravure, coil coating, flexographic methods and so forth as opposed to extrusion or film laminating methods which are expensive and may require off-line processing as well as large amounts of coating material. An extruded film, for example, may require 25 lbs/3000 $ft^2$ ream.

Carboxylated styrene-butadiene resins may be used with or without filler if so desired.

A layer comprising a latex may contain any suitable latex known to the art. By way of example, suitable latexes include styrene-acrylic copolymer, acrylonitrile styrene-acrylic copolymer, polyvinyl alcohol polymer, acrylic acid polymer, ethylene vinyl alcohol copolymer, ethylene-vinyl chloride copolymer, ethylene vinyl acetate copolymer, vinyl acetate acrylic copolymer, styrene-butadiene copolymer and acetate ethylene copolymer. Preferably, the layer comprising a latex contains styrene-acrylic copolymer, styrene-butadiene copolymer, or vinyl acetate-acrylic copolymer. More preferably, the layer comprising a latex contains vinyl acetate ethylene copolymer. A commercially available vinyl acetate ethylene copolymer is "AIRFLEX® 100 HS" latex. ("AIRFLEX® 100 HS" is a registered trademark of Air Products and Chemicals, Inc.) Preferably, the layer comprising a latex contains a latex that is pigmented. Pigmenting the latex increases the coat weight of the layer comprising a latex thus reducing runnability problems when using blade cutters to coat the substrate. Pigmenting the latex also improves the resulting quality of print that may be applied to the coated paperboard. Suitable pigments or fillers include kaolin clay, delaminated clays, structured clays, calcined clays, alumina, silica, aluminosilicates, talc, calcium sulfate, ground calcium carbonates, and precipitated calcium carbonates. Other suitable pigments are disclosed, for example, in Kirk-Othmer, Encyclopedia of Chemical Technology, Third Edition, Vol. 17, pp. 798, 799, 815, 831-836. Preferably the pigment is selected from the group consisting of kaolin clay and conventional delaminated coating clay. An available delaminated coating clay is "HYDRAPRINT" slurry, supplied as a dispersion with a slurry solids content of about 68 %. "HYDRAPRINT" slurry is a trademark of Huber. The layer comprising a latex may also contain other additives that are well known in the art to enhance the properties of coated paperboard. By way of example, suitable additives include dispersants, lubricants, defoamers, film-formers, antifoamers and crosslinkers. By way of example, "DISPEX N-40" is one suitable organic dispersant and comprises a 40 % solids dispersion of sodium polycarboxylate. "DISPEX N-40" is a trademark of Allied Colloids. By way of example, "BERCHEM 4095" is one suitable lubricant and comprises 100% active coating lubricant based on modified glycerides. "BERCHEM 4095" is a trademark of Bercen. By way of example, "Foamaster DF-177NS" is one suitable defoamer. "Foamaster DF-122 NS" is a trademark of Henkel. In a preferred embodiment, the coating comprises multiple layers that each comprise a latex.

Typically paperboard containers contain up to about 6 % starch; however, the rigidity can be considerably enhanced by using paperboard with from about 9 to about 12 weight percent starch. See U.S. Pat. Nos. 5,938,112 and 5,326,020, the disclosures of which are incorporated herein by reference.

The stock is moistened on the uncoated side after all of the printing and coating steps have been completed. In a typical forming operation, the web of paperboard stock is fed continuously from a roll through a scoring and cutting die to form the blanks which are scored and cut before being fed into position between the upper and lower die halves. The die halves are heated as described above, to aid in the forming process. It has been found that best results are obtained if the upper die half and lower die half—particularly the surfaces thereof—are maintained at a temperature in the range of from about 250° F. to about 400° F., and most preferably at about 325° F.±25° F. These die temperatures have been found to facilitate the plastic deformation of paperboard in the rim areas if the paperboard has the preferred moisture levels. At these preferred die temperatures, the amount of heat applied to the blank is sufficient to liberate the moisture within the blank and thereby facilitate the deformation of the fibers without overheating the blank and causing blisters from liberation of steam or scorching the blank material. It is apparent that the amount of heat applied to the paperboard will vary with the amount of time that the dies dwell in a position pressing the paperboard together. The preferred die temperatures are based on the usual dwell times encountered for normal plate production speeds of 40 to 60 pressings a minute, and commensurately higher or lower temperatures in the dies would generally be required for higher or lower production speeds, respectively.

Without intending to be bound by theory, it is believed that increased moisture, temperature, and pressure in the region of the pleat during pleat formation facilitates rebonding of lamellae in the pleats; accordingly, if insufficient rebonding is experienced, it can generally be addressed by increasing one or more of temperature, pressure or moisture.

A die set wherein the upper assembly includes a segmented punch member and is also provided with a contoured upper pressure ring is advantageously employed in carrying out the present invention. Pleating control is preferably achieved in some embodiments by lightly clamping the paperboard blank about a substantial portion of its outer portion as the blank is pulled into the die set and the pleats are formed. For some shapes the sequence may differ somewhat as will be appreciated by one of skill in the art. Draw and/or pressure rings may include one or more of the features: circular or other shape designed to match product shape; external location with respect to the forming die or punch base and die or base contour; stops (rigid or rotating) connected thereto to locate blank prior to formation; cut-out "relief" area that is approximately the same depth as the paperboard caliper and slightly larger than the blank diameter to provide a reduced clamp force before pleating starts to reduce clamp force during draw-in of the; this provides initial pleating control before outer portions of the mold contact the paperboard and provides final pleating control; optional relief areas may be desirable to reduce tension and stretch that may damage coating during formation; optionally including radiused outer edges to reduce tension and stretch that may damage the coating during formation; 3 to 4 L-shaped brackets each (stops) are bolted into both the draw and pressure rings around their perimeters and contact milled-out areas in the respective die and punch forming bases or contours to provide the springs with preload distances and forces; typical metal for the draw ring is steel, preferably AISI 1018, typical surface finishes of 125 rms are standard for the draw ring, 63 rms are desired for the horizontal top surface, and inner diameter, a 32 rms finish is desired on the horizontal relief surface; pins and bushings are optionally added to the draw and pressure rings and die and punch bases to minimize rotation of the rings; inner diameter of the pressure ring may be located relatively inwardly at a position generally corresponding to the outer part of the second annular transition of the container or relatively outwardly at a position generally corresponding to the inner part of an arcuate outer flange or at a suitable location therebetween; the draw and pressure ring inner diameters should be slightly larger than the matching bases/contours such as to provide for free movement, but not to allow significant misalignments due to loose tolerencing; 0.005" to 0.010" clearance per side (0.010" to 0.020" across the diameter) is typical; 4 to 8 compression springs each per draw ring and pressure ring typically are used to provide a preload and full load force under pre and full deflections; machined clearance holes for the springs should be chamfered to ensure no binding of the springs during the deflection; the spring diameters, free lengths, manufacturer and spring style can be chosen as desired to obtain the desired draw ring and pressure ring preloads, full load and resulting movements and clamping action; to obtain the desired clamping action the preload of the pressure ring springs (total force) should be slightly greater that the fully compressed load of the draw ring springs (total force); the preload of the draw ring springs should be chosen to provide adequate pleating control while not clamping excessively hard on the blank while in the draw ring relief; for example, (6) draw ring compression springs LC-059G-11 SS (0.48" outside diameter, 0.059" wire diameter, 2.25" free length, spring rate 18 lb/in×0.833 (for stainless steel)=14.99 lb/in, and a solid height of 0.915"); a 0.375" preload on each spring provides a total preload force of (6)×14.99 lb/in×0.375"=33.7 lbs; an additional deflection of the springs of 0.346" or (0.721" total spring deflection) results in a total full load force of (6)×14.99 lb/in×0.721"=64.8 lbs; (6) pressure ring compression springs LC-080J-10 SS (0.75" outside diameter, 0.080" wire diameter, 3.00" free length, spring rate of 20.23 lb/in×0.833 (for stainless steel)=16.85 lb/in, and a solid height of 10.95"; a 0.835" preload on each spring provides a total preload force of (6)×16.85 lb/in×0.835"=84.4 lbs (greater than draw ring full deflection spring load total force); an additional deflection of the springs of 0.46" (1.295" total spring deflection) results in a total full load force of (6)×16.85 lb/in×1.295"=130.9 lbs; or for example, (4) draw ring compression springs LC-067H-7 SS (0.60" outside diameter, 0.067" wire diameter, 1.75" free length, spring rate 24 lb/in×0.833 (for stainless steel)=19.99 lb/in, and a solid height of 0.705"); a 0.500" preload on each spring provides a total preload force of (4)×19.99 lb/in×0.500"=40.0 lbs; an additional deflection of the springs of 0.40" or (0.90" total spring deflection) results in a total full load force of (4)×19.99 lb/in×0.90"=72.0 lbs; (8) pressure ring compression springs LC-049E-18 SS (0.36" outside diameter, 0.049" wire diameter, 2.75" free length, spring rate of 14 lbs/in×0.833 (for stainless steel)=11.66 lb/in, and a solid height of 1.139"; a 1.00" preload on each spring provides a total preload force of (8)×11.66 lb/in×1.00"=93.3 lbs (greater than draw ring fully deflection spring load total force); an additional deflection of the springs of 0.50" (1.500" total spring deflection) results in a total full load force of (8)×11.66 lb/in×1.500"=140 lbs. The springs referred to above and below are available from Lee Spring Co. Many other suitable components may of course be employed when making the inventive containers from paperboard.

For a typical 9" plate, selections for a particularly preferred apparatus might include (6) draw ring compression springs LC-059G-11 SS (0.48" outside diameter, 0.059" wire diameter, 2.25" free length, spring rate 18 lb/in×0.833 (for stainless steel)=14.99 lb/in, and a solid height of 0.915"); a 0.473" preload on each spring provides a total preload force of (6)×

14.99 lb/in×0.473"=42.5 lbs; an additional deflection of the springs of 0.183" or (0.656" total spring deflection) results in a total full load force of (6)×14.99 lb/in×0.656"=59.0 lbs; (6) pressure ring compression springs LC-080J-10 SS (0.75" outside diameter), 0.080" wire diameter, 3.00" free length, spring rate of 20.23 lb/in×0.833 (for stainless steel)=16.85 lb/in, and a solid height of 0.915"; a 0.692" preload on each spring provides a total preload force of (6)×16.85 lb/in×0.692"=70 lbs (greater than draw ring full deflection spring load total force); an additional deflection of the springs of 0.758" (1.450" total spring deflection) results in a total full load force of (6)×16.85 lb/in×1.450"=146.6 lbs.

Selections for a 10" plate might include, (6) draw ring compression springs LC-059G-11 SS (0.48" outside diameter, 0.059" wire diameter, 2.25" free length, spring rate 18 lb/in×0.833 (for stainless steel)=14.99 lb/in, and a solid height of 0.915"); a 0.621" preload on each spring provides a total preload force of (6)×14.99 lb/in×0.621"=55.9 lbs; an additional deflection of the springs of 0.216" or (0.837" total spring deflection) results in a total full load force of (6)×14.99 lb/in×0.837"=75.3 lbs; (6) pressure ring compression springs LC-080J-10 SS (0.75" outside diameter), 0.080" wire diameter, 3.00" free length, spring rate of 20.23 lbs/in×0.833 (for stainless steel)=16.85 lb/in, and a solid height of 1.095"; a 0.878" preload on each spring provides a total preload force of (6)×16.85 lb/in×0.878"=88.8 lbs (greater than draw ring full deflection spring load total force); an additional deflection of the springs of 0.861" (1.739" total spring deflection) results in a total full load force of (6)×16.85 lb/in×1.739"=175.8 lbs.

Figure 2:
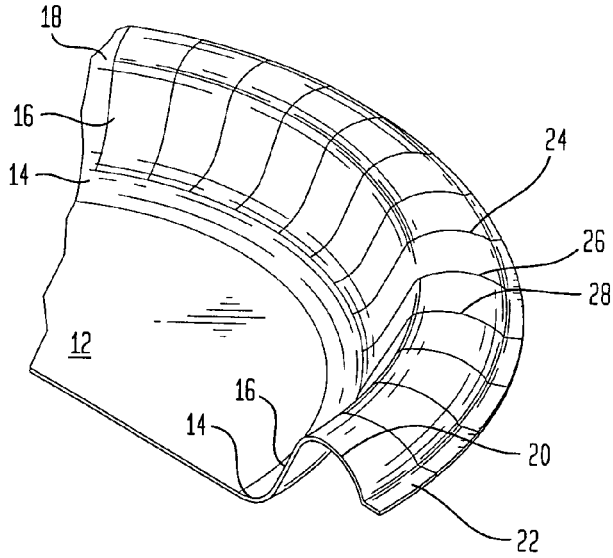
FIG. 2 is a view in partial section illustrating the profile of the plate of FIG. 1.

Referring now to FIGS. 1 and 2, there is illustrated a plate 10 made from a substantially planar paperboard blank. Plate 10 includes a planar bottom 12, a first transition 14, a sidewall 16, a second transition 18 and an arcuate outer flange portion 20. Optionally provided is an outer evert 22 which provides additional strength to the container. Pressed paperboard containers such as plate 10 typically include a plurality of pleats such as pleats 24, 26, 28 and so forth because of the excess paperboard in a circumferential direction when a flat blank is formed into the shaped product, as will be appreciated by one of skill in the art.

Figure 3:
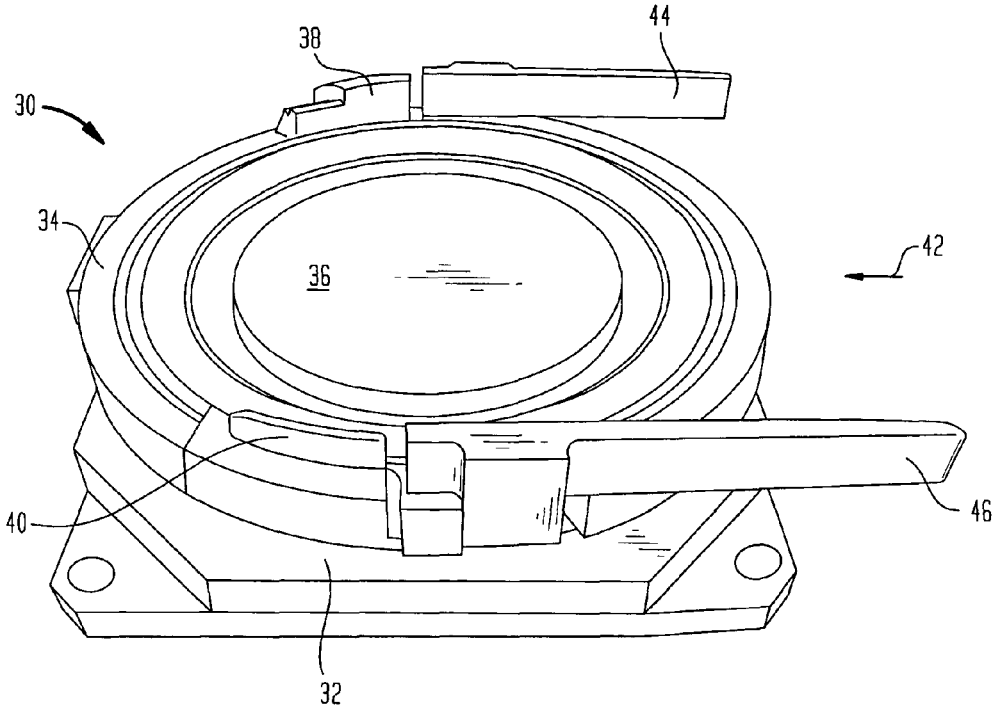
FIG. 3 is a schematic view in perspective of the die portion of a segmented die set of the class used to make pressware containers.

Typically, a container such as plate 10 is formed in an automated pressware apparatus which includes a plurality of die sets, each including a punch and a die such as die 30 shown in FIG. 3. Die 30 is mounted on a mounting plate 32 and is optionally a segmented die including a draw ring 34, a knock-out 36, a pair of forward blank stops 38, 40 as is shown. A flat paperboard blank is generally passively fed to die 30 by gravity, guided along a production direction 42 by blank guides 44, 46. The die set is typically inclined so that blanks and product are advanced by gravity as is well known. A blank fed to the die set is formed into shape by the die set.

Figures 4, 4A:
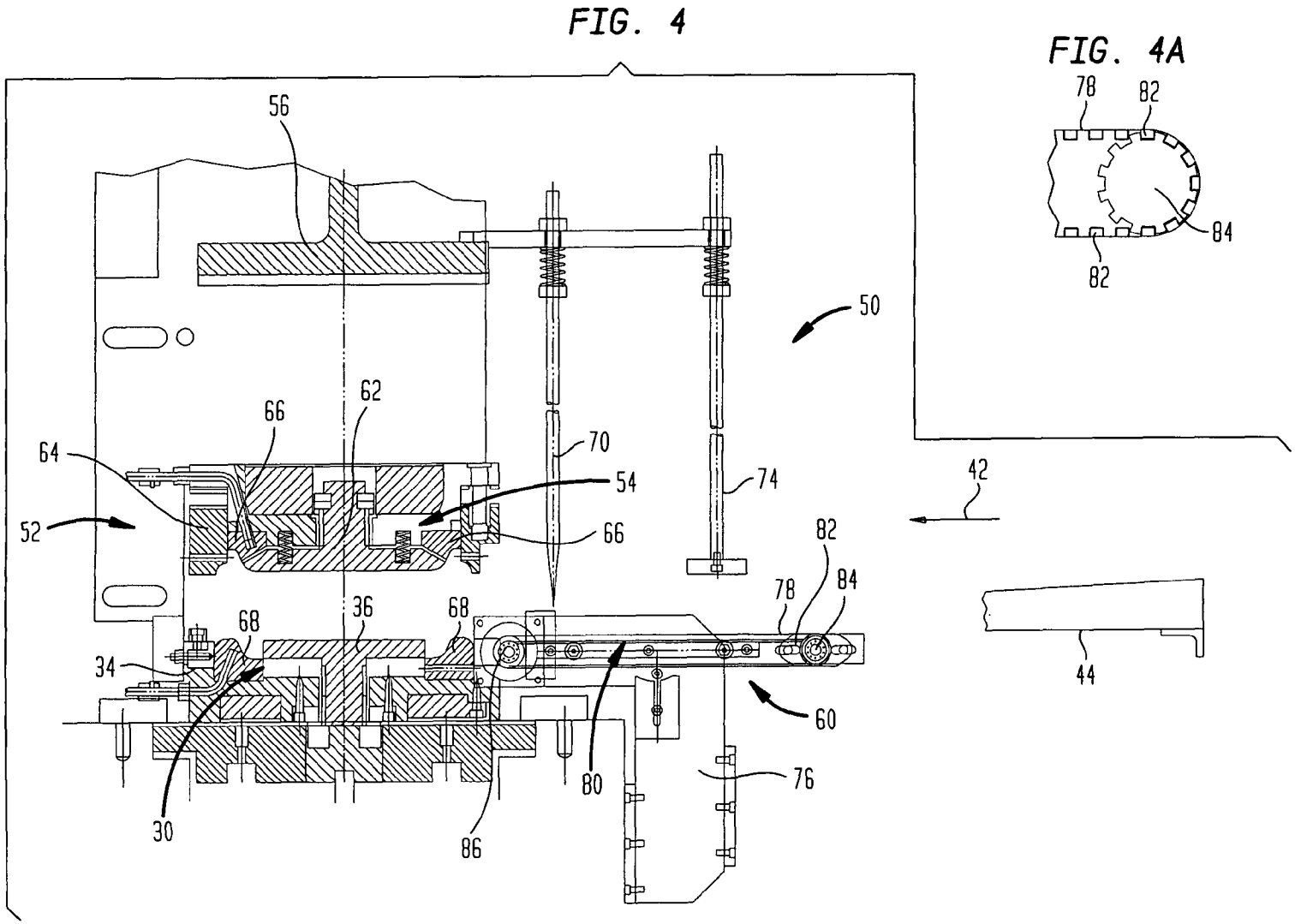
FIG. 4 is a schematic view in elevation of an improved apparatus of the current invention.
FIG. 4A is an enlarged schematic detail showing a portion of the timing belt and sprocket wheel.
Figure 5:
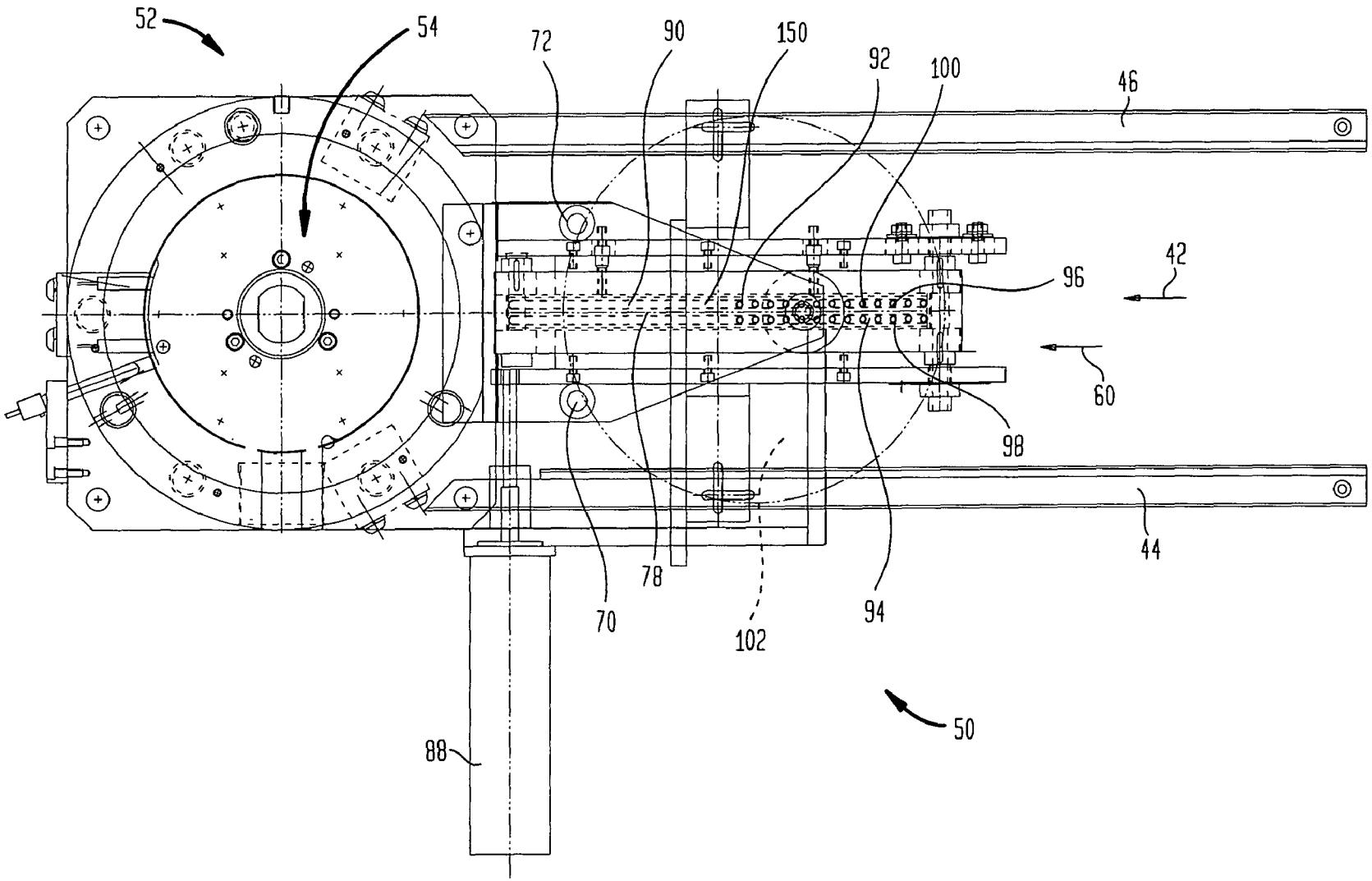
FIG. 5 is a schematic top view of the forming station of FIG. 4.
Figure 6:
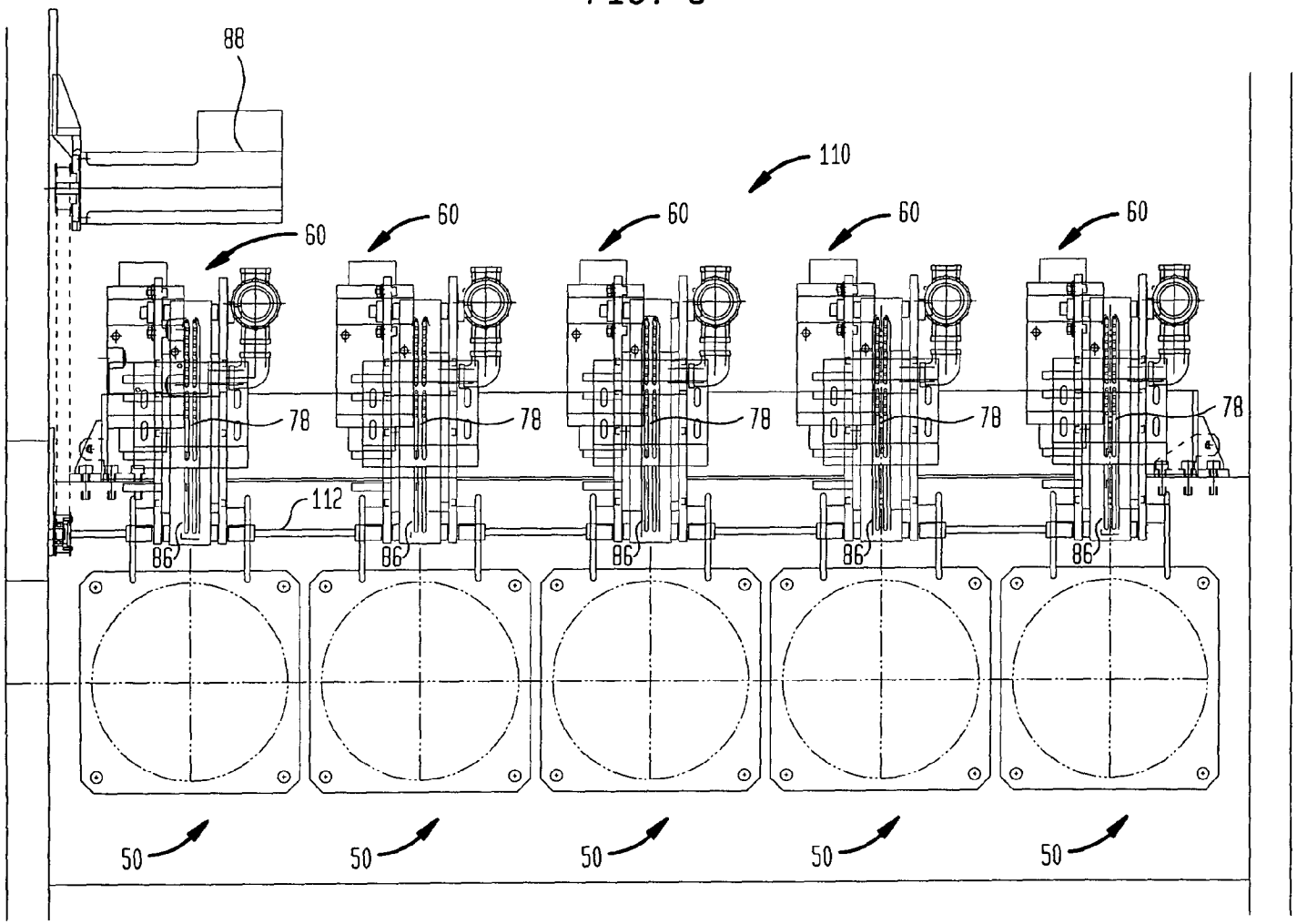
FIG. 6 is a schematic view of a plurality of forming stations such as those shown in FIGS. 4 and 5 wherein the feed belt is linked to a common servo-motor drive.

Rather than a passive gravity feed system, it has been found that higher speed and more reliable operation is achieved with an active, vacuum feed system as is illustrated schematically in FIGS. 4, 5 and 6.

The improved apparatus 50 includes generally a pressware die set 52 including a punch 54 driven by a forming ram 56, as well as a die 30 and an active vacuum feed system 60.

Punch 54 includes a knock-out 62, a pressure ring 64, and a punch base 66. The knock-out is optionally spring biased as shown. Die 30 has draw ring 34, knock-out 36 as well as base 68 which defines a contour transferred to the blank in order to form the container.

Included in the feed system are stop pins 70, 72 as well as an optional tamper 74 along with a vacuum source indicated at 76, a pervious timing belt 78 and a vacuum chamber 80 underneath feed belt 78. Chamber 80 is coupled to source 76.

Feed belt 78 has teeth or cogs indicated at 82 and is mounted about a pair of sprocket wheels 84, 86 as shown so that the belt does not slip and can be precision driven by a servo-motor 88, as will be appreciated from FIGS. 4A and 6.

Chamber 80 communicates vacuum to the belt by way of a plurality of slots 90, 92, 94 and so forth, which vacuum is transferred to the upper surface of the belt through holes 96, 98, 100 and so on.

In operation, a planar paperboard blank 102 is gravity fed and guided by guides 44, 46 to timing belt 78 and stopped by retractable pins 70, 72 which are mounted on the forming ram. Belt 78 may be continuously supplied with vacuum or intermittently supplied with vacuum by way of solenoid valves (not shown) between source 76 and chamber 80. Optional tamper 74 urges the blank against the belt.

The level of vacuum required to secure the plate onto belt 78 is not high, anywhere from 5 inches to 20 inches of water sufficing depending upon paperboard thickness. In any event, vacuum should be operative to releasably secure the blank to the belt, which is advanced by motor 88 in production direction 42 to supply the blank to the die set.

Belt 78 has a circumference slightly larger than 2 blank diameters as is appreciated from the diagram and may be made of rubber or other suitable material. The relative dimensions of the blank and belt are such that the blank is partially engaged with the belt as its forward portion enters the die set in a feeding step.

The feeding step begins when the blank is on the belt in the position shown in FIG. 5. The belt is then advanced in direction 42, first being accelerated to an elevated velocity, V, with the plate secured thereto and then being decelerated with the plate secured thereto to a lower velocity prior to completing the feed of the blank into the die set. That is to say, the belt operates to slow the blank down before it is released to the die set. This feature helps to prevent bounce back, which is further controlled with retainers on the draw ring as further discussed herein.

In practical applications, the invention may be utilized in a 5 station press 110 as is shown in FIG. 6. In FIG. 6, there are provided 5 die sets 50 adjacent 5 vacuum blank feeders 60, each of which has a belt 78 as described above and is driven with a sprocket wheel 86. The sprocket wheels 86 are coupled to a common shaft 112 which, in turn, is driven by a single servo-motor 88. In this way, production of numerous press stations is coordinated by simply controlling and coordinating feed steps by actively providing the blanks to the forming station.

"Bounce back" is reduced by reducing the final velocity at which blanks are supplied to the die set and optionally can be further controlled by providing draw ring 34 with rearward ramped blank retainers which limit "bounce back" from forward blank stops 38, 40 (FIG. 1) when the blank hits the forward steps.

Figure 7A:
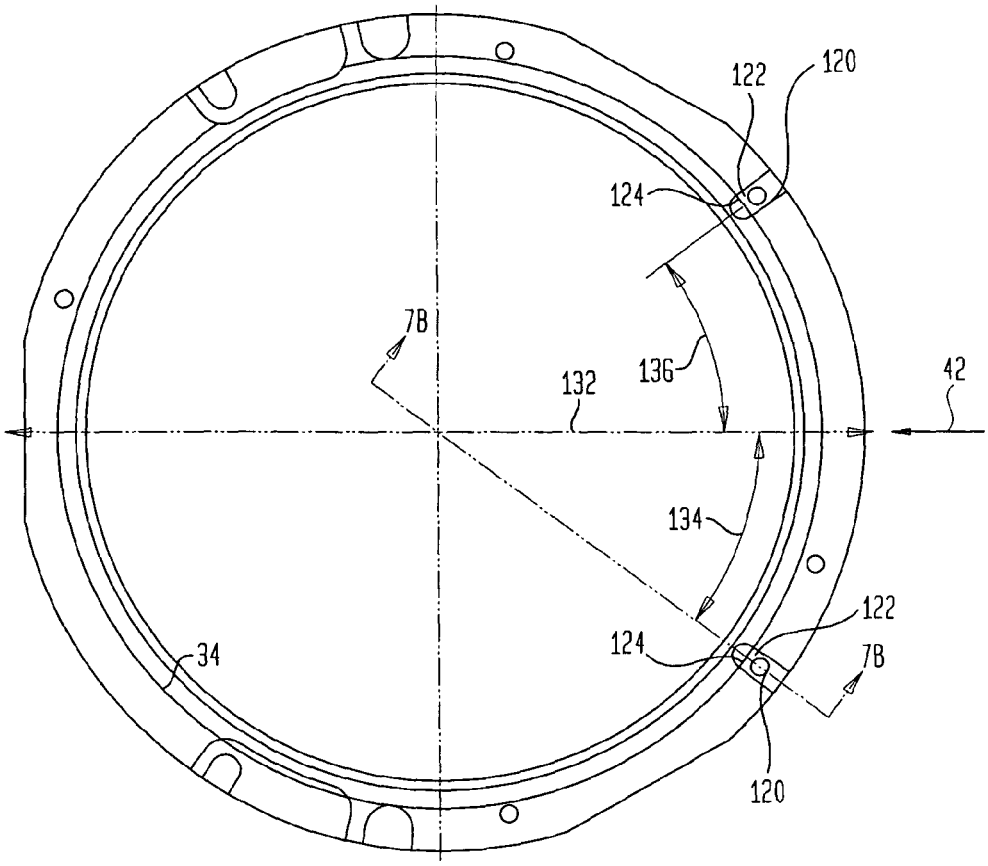
FIG. 7A is a schematic top view of a draw ring of a die provided with ramped rearward blank retainers.
Figure 7B:
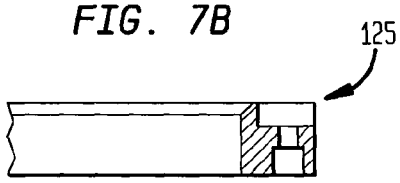
FIG. 7B is a partial profile from center of the ring of FIG. 7A.
Figure 8A:
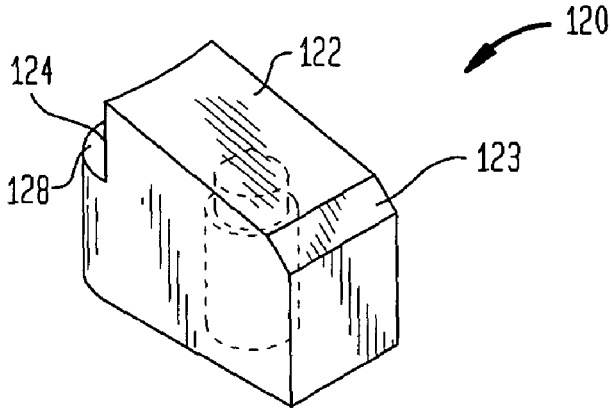
FIG. 8A is a perspective view of a ramped rearward blank retainer.
Figure 8B:
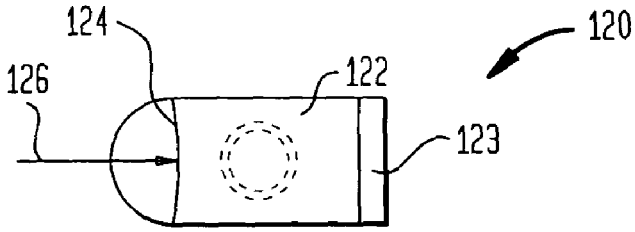
FIG. 8B is a top view of the ramped rearward blank retainer of FIG. 8A.
Figure 8C:
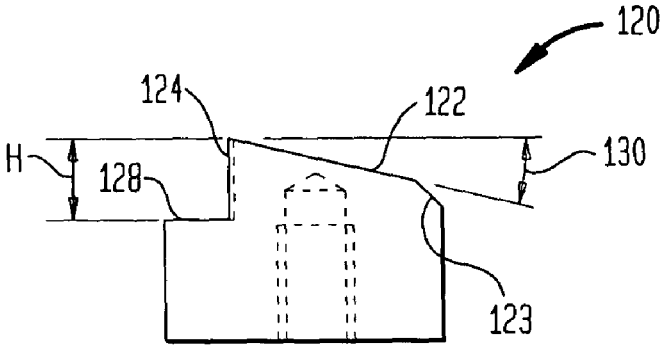
FIG. 8C is a side view in elevation of the ramped rearward blank retainer of FIGS. 8A and 8B.

There is shown in FIGS. 7A and 7B, draw ring 34. FIG. 7A is a plan view, while FIG. 7B shows the profile 125 adapted for receiving ramped rearward blank retainers 120 which are shown in more detail in FIGS. 8A-8C. As shown in FIGS. 8A-8C, the retainers have a sloped outer surface 122, a beveled outer corner 123, as well as an inner lip 124. Lip 124 defines a radius of curvature 126 which is preferably substantially the same radius of curvature as a blank to be formed in the die set. There is further provided a shelf 128 configured to be flush with the adjacent surface of the draw ring which is deemed a processing surface. Sloped surface 122 defines an angle 130 with respect to surface 128 which is anywhere from about 5 to about 20 degrees, whereas the height, H, of lip 124 above surface 128 is typically from about 0.15 to about 0.3 inches.

Two retainers 120 are positioned on draw ring 34 separated by symmetrical angles from a medial axis 132 along direction 42. The medial axis bisects the die into equal halves. Angles 134, 136 are preferably equal to each other and may be from about 30 to about 50 degrees.

Figure 10:
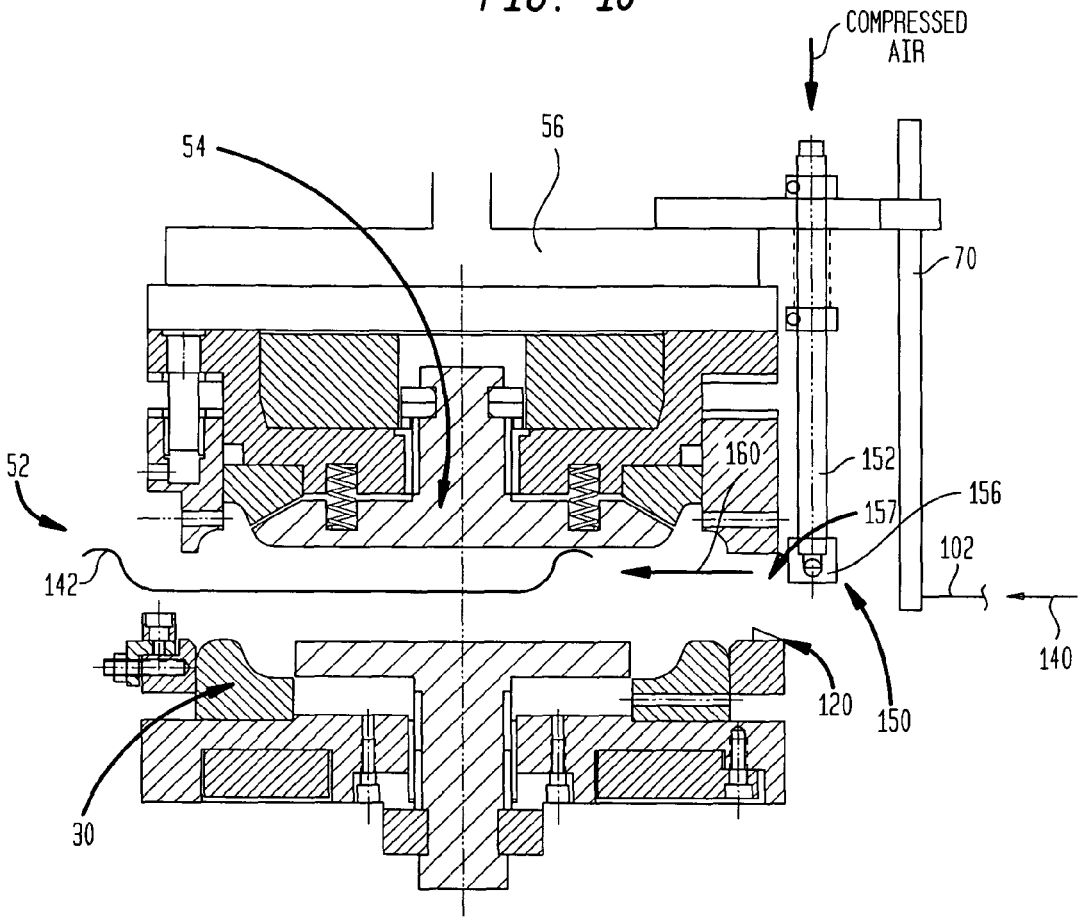
FIG. 10 is a schematic side view in elevation of a forming station showing an improved air-assist ejection system and the ramped rearward blank retainer of the invention.
Figure 11:
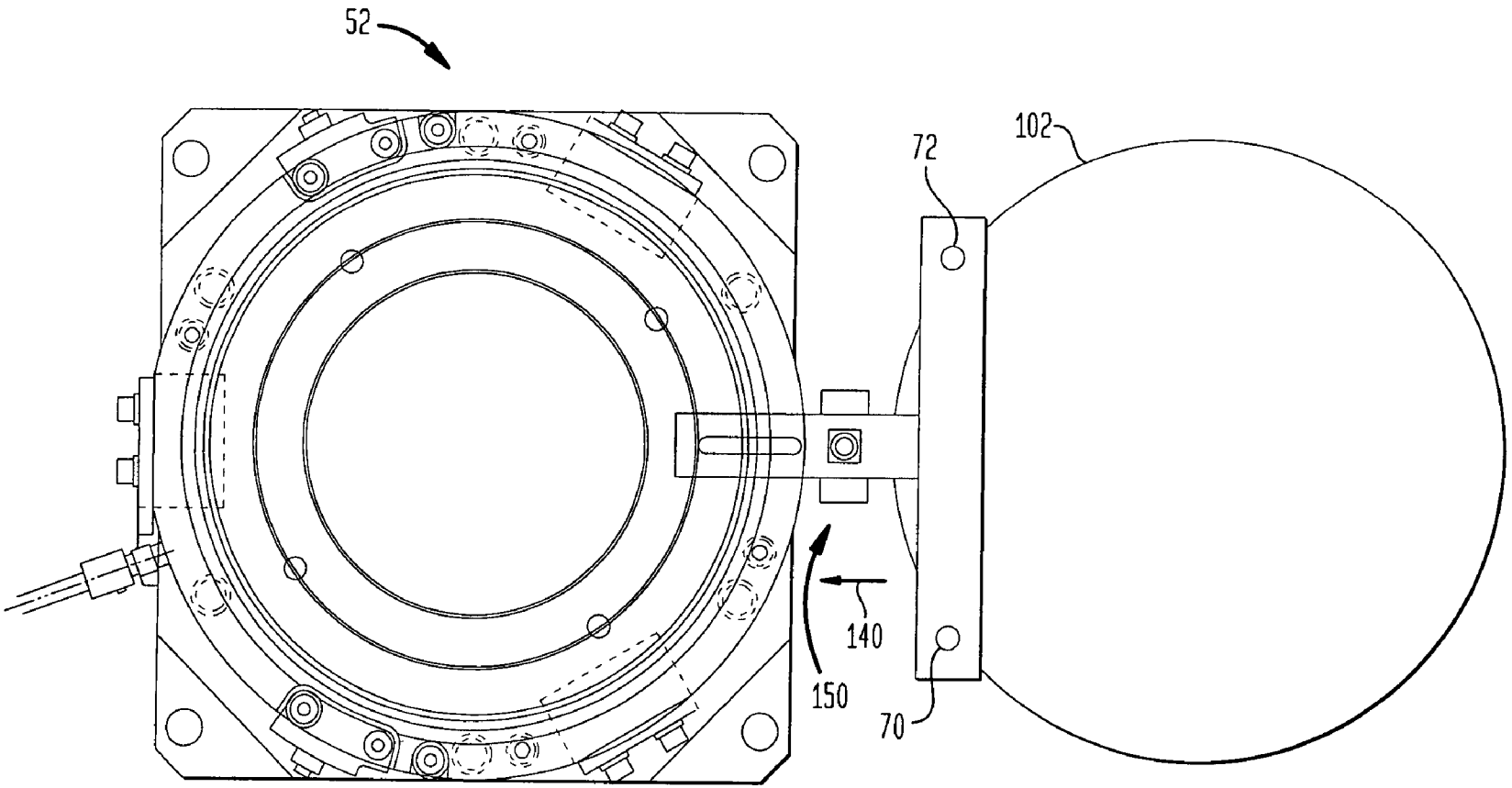
FIG. 11 is a schematic top view of the forming station of FIG. 10.
Figure 12A:
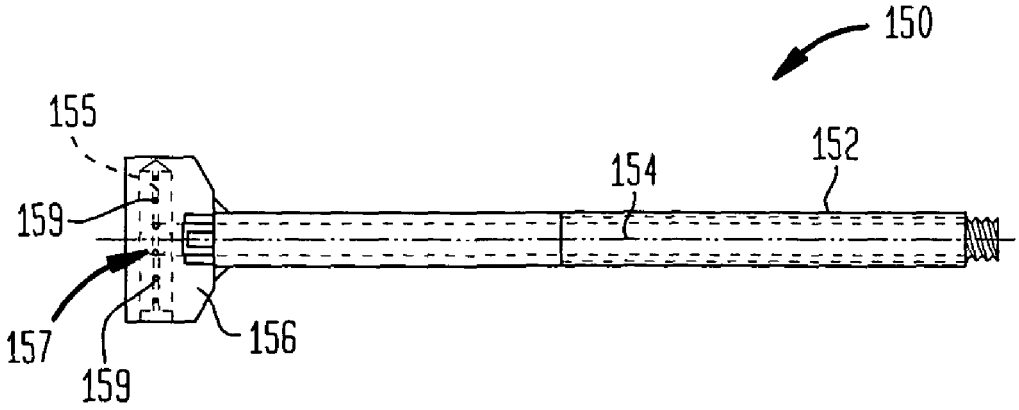
FIGS. 12A and 12B are enlarged details showing an ejector nozzle and air supply conduit.
Figure 12B:
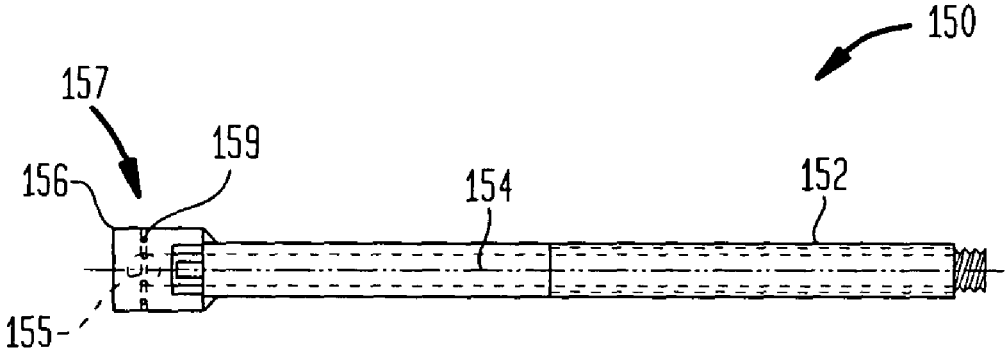

In operation, the outer sloping surfaces 122 of retainers allow a blank to slide into the die, whereas lips 124 prevent back up as will be further appreciated from FIG. 10 where a retainer is shown schematically at the rearward part of the die with respect to production direction 140 and wherein the die has rotating pin forward blank stops. Note that a groove corresponding to the lip must be provided in pressure ring 64 to allow the die set to operate properly.

Figure 9:
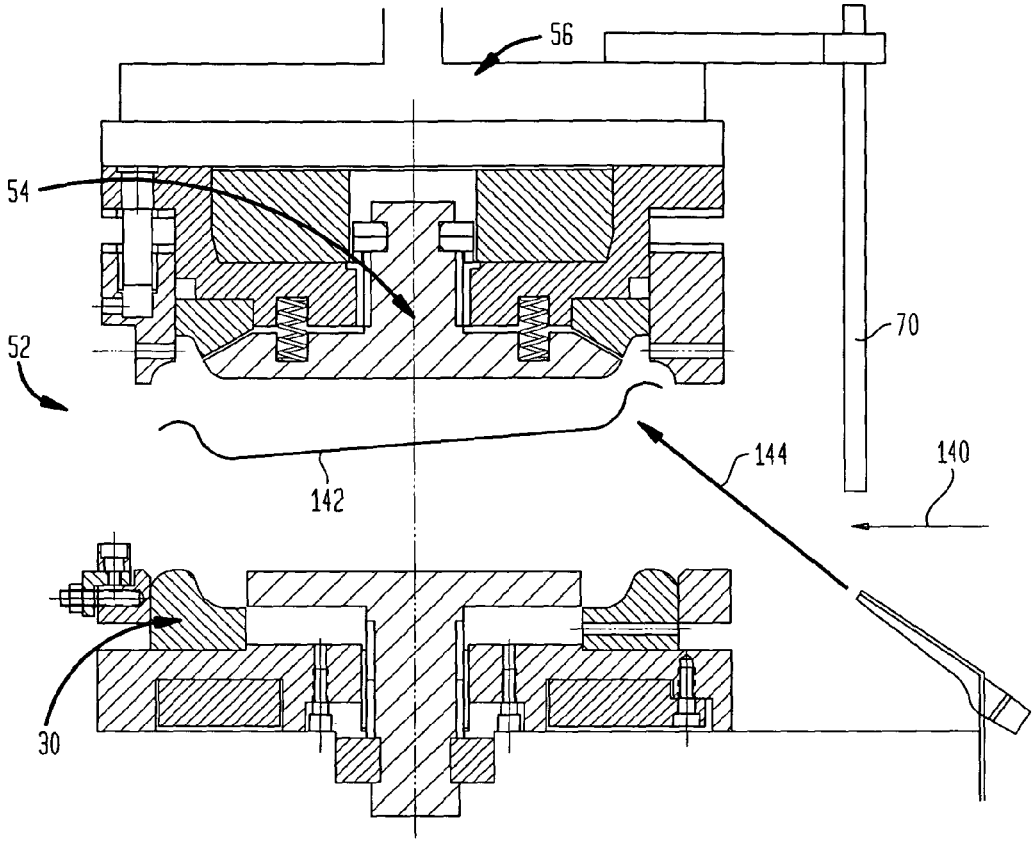
FIG. 9 (PRIOR ART)
FIG. 9 is a schematic side view in elevation of a forming station showing a currently employed air-assist ejector system.

Just as reliable feeding is important to efficient operation of pressure die sets, reliable removal of formed product from the forming cavity is likewise important. In this respect, it is known to use pneumatic ejectors to assist in product removal as is shown in FIG. 9. There is shown there a die set 52 including a punch 54 and a die 30 as described hereinabove. A paperboard blank 102 is fed to the die set along a feed path 140 and subsequently formed into a plate 142. Depending upon speeds desired, tackiness of the product and so forth, an air assist is provided along path 144 to clear the product from the mold. As will be appreciated from FIG. 9, however, the duration of the air assist blast is limited by the frequency of the blank feed inasmuch as the air stream does not avoid the feed path of the blanks.

An improved system is shown in FIGS. 10-12B. In FIG. 10 there is illustrated a die set 52 provided with a punch 54, a die 30 as well as a pneumatic product ejector 150 mounted on forming ram 56.

Ejector 150 is coupled to a compressed air source and includes an elongate feed conduit 152 provided with a central bore 154 as well as a nozzle portion 156 having a nozzle conduit 155 as well as 16 small diameter holes 159 collectively defining a high velocity nozzle output 157 directed along production direction 160 above feed path 140 of the blanks.

By virtue of its positioning, ejector 150 can be left on longer than prior art systems since feed path 140 of the blanks is avoided. Indeed, the ejector can be left on even during a portion of the feed step of the blanks, since the air stream path 160 avoids the feed path 140 and is incident directly onto formed product 142. Typically, central bores 154 and 155 are circular bore having a diameter of ¼ inch or so, while the nozzle holes 159 are likewise circular bores with a diameter of 50 mils or so. The nozzle is operated at any suitable pressure, such as an air pressure of from 20 to 80 psig. The air may be left on for about 80 degrees or more of a 360 degree production cycle in typical cases.

Figure 13:
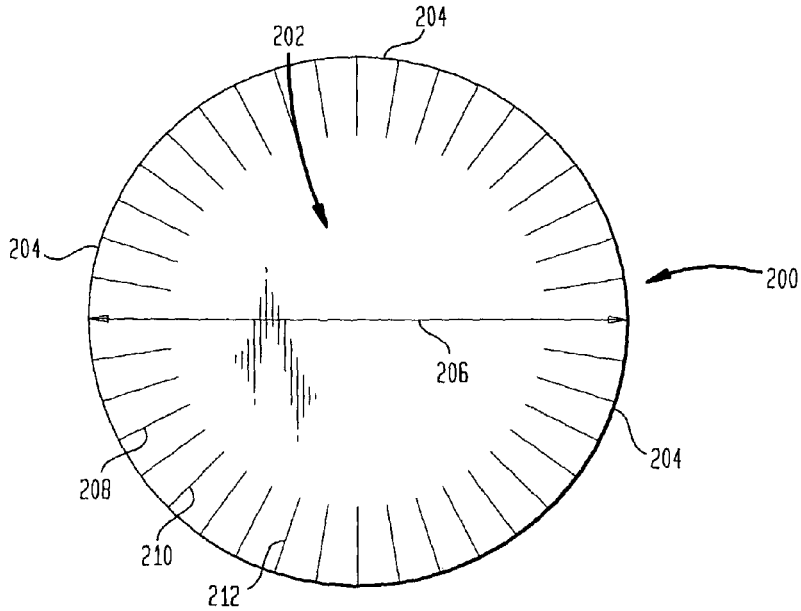
FIG. 13 is a top view of a scored paperboard blank used in accordance with the present invention.

Product formed in accordance with the present invention is most preferably made with a scored blank 200, which has a central unscored area 202, a peripheral edge 204, a diameter 206 as well as scores, such as evenly spaced scores 208, 210 and 212 as is seen in FIG. 13. The scores facilitate regular formation of pleats having preferred micro structures as discussed in connection with FIG. 14 and following.

Figure 14:
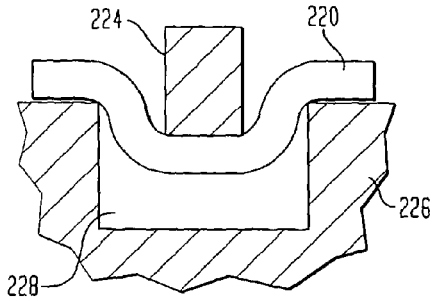
FIGS. 14-16 are schematic diagrams illustrating scoring and pleating of a paperboard blank into a container.
Figure 15:
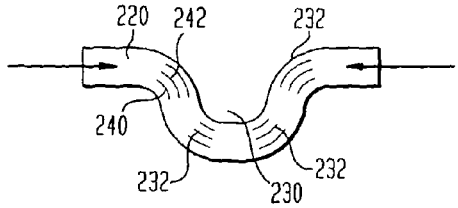
Figure 16:
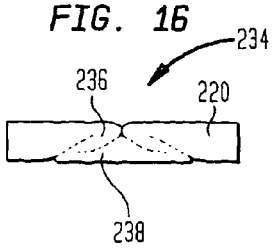

In FIG. 14 there is shown a portion of paperboard stock 220 positioned between a score rule 224 and a scoring counter 226 provided with a channel 228 as would be the case in a scoring press or scoring portion of a pressware forming press. The geometry is such that when the press proceeds reciprocally downwardly and scores blank, U-shaped score 230 results. At least incipient delamination of the paperboard into lamellae indicated at 232, 240 and 242, is believed to occur in the sharp corner regions indicated at in FIG. 15. The same reciprocal scoring operation could be performed in a separate press operation to create blanks that are fed and formed subsequently. Alternatively, a rotary scoring and blanking operation may be utilized as is known in the art. When the product is formed in a heated matched die set, a U-shaped pleat with a plurality of lamellae of rebonded paperboard along the pleat in the product is formed such that the pleats generally have such configuration. The structure of pleat is preferably as shown schematically in FIG. 16. During the forming process, a pleat 234 is formed, which process includes rebonding of the lamellae under heat and pressure into a substantially integrated fibrous structure generally inseparable into its constituent lamellae. Preferably, pleat 234 has a thickness generally equal to the circumferentially adjacent areas of the rim and most preferably is more dense than adjacent areas. Integrated structures of rebonded lamellae are indicated schematically at 236, 238, in FIG. 16 on either side of paperboard fold lines in the pleat indicated in dashed lines.

The substantially rebonded portion or portions of the pleats in the finished product preferably extend generally over the entire length (75 % or more) of the score which was present in the blank from which the product was made. The rebonded portion of the pleats may extend only over portions of the pleats in an annular region of the periphery of the article in order to impart strength. Such an annular region or regions may extend, for example, around the container extending approximately from the transition of the bottom of the container to the sidewall outwardly to the outer edge of the container, that is, generally along the entire length of the pleats shown in the Figures above. The rebonded structures may extend over an annular region which is less than the entire profile from the bottom of the container to its outer edge.

Figure 17:
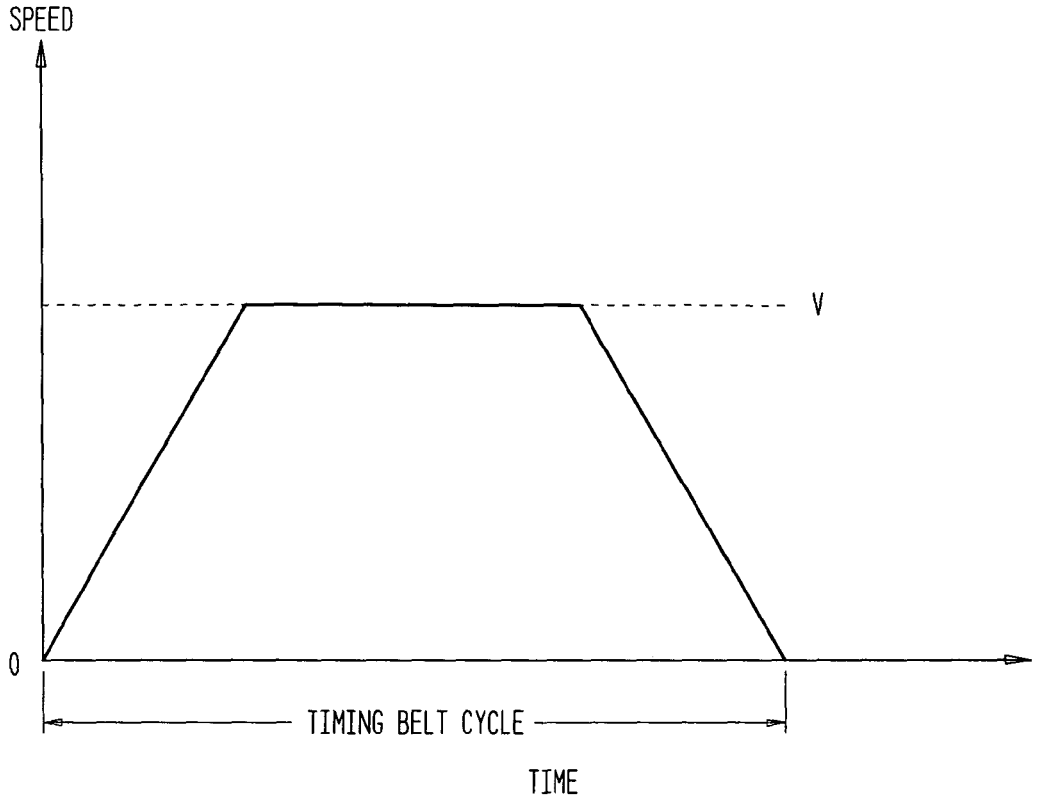
FIGS. 17 and 18 are diagrams illustrating operation of the improved pressware system.
Figure 18:
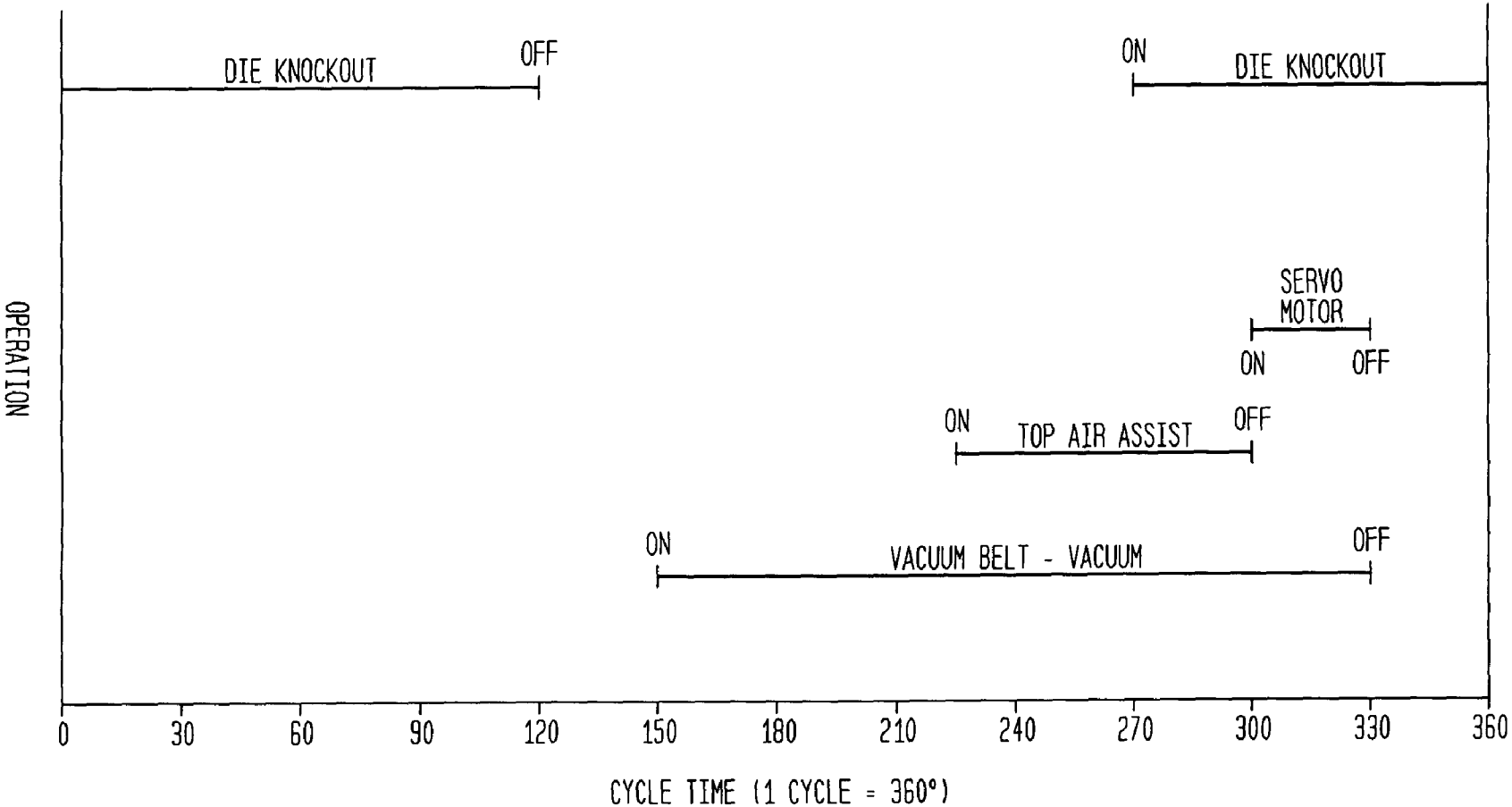

Operation of the improved pressware system is better appreciated by reference to FIGS. 17 and 18. FIG. 17 is a plot of vacuum feed belt velocity during the time a blank is being fed to the die set, that is, when the servo-motor 88 is on. A t=0 belt 78 is stopped and the paperboard blank is secured to the feed belt by vacuum. The feed belt accelerates to an elevated velocity, V, which remains relatively constant for slightly more than half of the duration of the feed step (shown in FIG. 17) and decelerates back to a zero velocity at the end of the feed step. The blank is thus supplied to the forming cavity at a velocity much less than V. For a typical die set operating at 50 pressings a minute, the average velocity of the blank during the feed step is typically in the range of from about 400 feet per minute to about 800 feet per minute, with the elevated velocity being much higher, typically from about 750 feet per minute to about 1500 feet per minute. The feed step typically has a duration (the time the servo-motor is on) of 80-90 milliseconds at a production rate of 50 pressings a minute as will further be appreciated from FIG. 18.

FIG. 18 is a timing diagram showing the duration of various steps during a production cycle of the improved pressware die set. The cycle is expressed in degrees, i.e., 1 cycle being 360°. At 0° the die set is fully open and die knock-out 36 is on, that is extended away from the base. At 180° the die set is fully closed for forming and is again fully open at 360°, the die knock-out thus being "off" at the middle portion of the press cycle.

The belt servo-motor activates the belt at about 300° to about 330° for about 80-90 milliseconds as noted above and seen in FIG. 18, reaching an elevated velocity of from about 750-1500 feet per minute, much faster than is possible with gravity feed systems.

The air ejector is on between about 215° and 300° in the cycle, but may be left on longer since it does not interfere with blank feeding. This feature is particularly advantageous if gravity feeding of the blanks is performed instead of using the vacuum timing belt.

Vacuum is supplied to the belt between 150° and 330° of the cycle and may be controlled by solenoid valves, if so desired. Alternatively, vacuum may be continuously supplied to the vacuum belt, if so desired, in order to simplify control of the systems in view of the fact that a low vacuum, i.e., 30 inches of water vacuum or less, is needed to secure the blanks to the feed.

While the invention has been described in connection with several examples, modifications to those examples within the spirit and scope of the invention will be readily apparent to those of skill in the art. In view of the foregoing discussion, relevant knowledge in the art and references including co-pending applications discussed above in connection with the claim for Priority, Background and Detailed Description, the disclosures of which are all incorporated herein by reference, further description is deemed unnecessary.

What is claimed is:

1. In a pressware apparatus for making pressed paperboard articles, the combination comprising:

(a) a die set including a punch and a die adapted for reciprocal motion with respect to each other and configured to cooperate in order to form a shaped product from a substantially planar paperboard blank upon pressing thereof;

(b) a variable speed blank feeder for controlled insertion of the paperboard blank into the die set including:

(i) a pervious feed belt adjacent the die set, the pervious belt having a circumference of from about 2.2 to about 2.8 times the length of the paperboard blank;

(ii) a vacuum source communicating with the pervious feed belt, the feed belt and vacuum source being adapted for receiving the paperboard blank and releasably securing it to a surface of the belt;

(iii) variable speed drive means suitable for advancing the feed belt in a feeding direction, the drive means being capable of accelerating the belt from a stationary condition between feeds to the die set to an elevated feed belt velocity during a blank feed step as well as decelerating the feed belt during the feed step to a lesser velocity, whereupon the blank is released to the die set at a velocity less than the elevated feed belt velocity.

2. The combination according to claim 1, wherein the pervious feed belt, vacuum source and drive means are adapted to cooperate to feed a paperboard blank to the die set while the blank is at least partially engaged with the pervious feed belt.

3. The combination according to claim 1, wherein the pervious feed belt is provided with positive engagement means.

4. The combination according to claim 3, wherein the drive means includes at least two sprocket wheels.

5. The combination according to claim 1, further including retractable stop means for stopping a blank supplied to the feeder on the feed belt.

6. The combination according to claim 1, further including a tamper configured to urge the paperboard blank into contact with the pervious feed belt.

7. The combination according to claim 1, wherein the vacuum source is a variable vacuum source.

8. The combination according to claim 1, wherein the vacuum source is a continuous vacuum source.

9. The combination according to claim 1, wherein the duration of the blank feed step is less than 1 second.

10. The combination according to claim 1, wherein the duration of the blank feed step is less than 0.5 seconds.

11. The combination according to claim 1, wherein the duration of the blank feed step is less than about 0.25 seconds.

12. The combination according to claim 1, wherein the duration of the blank feed step is less than about 0.1 second.

13. The combination according to claim 1, wherein the elevated speed belt velocity is from about 750 feet per minute to about 1500 feet per minute.

14. The combination according to claim 1, wherein the elevated speed belt velocity is from about 950 feet per minute to about 1350 feet per minute.

15. The combination according to claim 1, wherein the average speed of the feed belt is from about 400 feet per minute to about 800 feet per minute during the blank feed step.

16. The combination according to claim 1, wherein the average speed of the feed belt is from about 500 to about 700 feet per minute during the blank feed step.

17. A method for making pressed paperboard articles, comprising:

(a) providing a paperboard blank to a variable speed blank feeder including:

(i) a pervious feed belt;

(ii) a vacuum source communicating with the pervious feed belt, the feed belt and vacuum source being adapted for receiving the paperboard blank and releasably securing it to a surface of the belt; and (iii) variable speed drive means suitable for advancing the feed belt in a feeding direction;

(b) stopping the blank on the pervious feed belt and securing it thereto by way of applying vacuum to the pervious belt;

(c) feeding the blank from the feeder to a die set including a punch and a die adapted for reciprocal motion with respect to each other and configured to cooperate in order to form a shaped product from a substantially planar paperboard blank upon pressing thereof, the step of feeding the blank to the die set including accelerating the belt from a stationary condition to an elevated feed belt velocity, and decelerating the belt, whereupon the blank is released to the die set at a velocity less than the elevated feed belt velocity.

18. The method according to claim 17, wherein the step of feeding the blank to the die set has a duration of less than 1 second.

19. The method according to claim 17, wherein the step of feeding the blank to the die set has a duration of less than 0.5 seconds.

20. The method according to claim 17, wherein the paperboard blank is secured to the vacuum belt by vacuum of from about 5 to about 30 inches of water.

21. The method according to claim 17, wherein the paperboard blank is secured to the vacuum belt by vacuum of from about 7.5 to about 15 inches of water.

22. The method according to claim 17, wherein the elevated feed belt velocity is from about 750 to about 1500 feet per minute.

23. The method according to claim 17, wherein the elevated feed belt velocity is from about 950 to about 1350 feet per minute.

24. The method according to claim 17, wherein the blank is at least partially secured to the pervious belt when fed to the die set.

25. The method according to claim 17, wherein the paperboard blank is a scored paperboard blank.

26. The method according to claim 17, wherein the paperboard blank has a clay coating.

* * * * *